US007662016B2

(12) United States Patent
Okamoto et al.

(10) Patent No.: US 7,662,016 B2
(45) Date of Patent: Feb. 16, 2010

(54) TRANSFORMABLE TOY

(75) Inventors: Koji Okamoto, Kanagawa (JP); Ryosuke Toriyama, Kanagawa (JP); Shinya Saito, Kyoto (JP); Shinichi Hanamoto, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 845 days.

(21) Appl. No.: 10/557,508

(22) PCT Filed: May 18, 2004

(86) PCT No.: PCT/JP2004/006653

§ 371 (c)(1),
(2), (4) Date: Jan. 17, 2006

(87) PCT Pub. No.: WO2004/101097

PCT Pub. Date: Nov. 25, 2004

(65) Prior Publication Data

US 2006/0189251 A1 Aug. 24, 2006

(30) Foreign Application Priority Data

May 19, 2003 (JP) ..... 2003-141208

(51) Int. Cl.
*A63H 3/46* (2006.01)

(52) U.S. Cl. ..... 446/376; 446/487

(58) Field of Classification Search ..... 446/99–101, 446/320, 321, 376, 378, 383, 390, 487
See application file for complete search history.

(56) References Cited

U.S. PATENT DOCUMENTS

D278,643 S * 4/1985 Ogawa ..... D21/582
D279,592 S * 7/1985 Ogawa ..... D21/581
4,571,203 A * 2/1986 Murakami ..... 446/95
4,578,046 A * 3/1986 Ohno ..... 446/376
4,580,993 A * 4/1986 Ohno ..... 446/376
4,586,911 A * 5/1986 Murakami ..... 446/376
4,674,990 A * 6/1987 Ohno ..... 446/376
4,680,018 A * 7/1987 Ohno ..... 446/376
6,830,497 B1 * 12/2004 Lee et al. ..... 446/376

FOREIGN PATENT DOCUMENTS

JP 60-10697 1/1985

(Continued)

*Primary Examiner*—Gene Kim
*Assistant Examiner*—Scott Young
(74) *Attorney, Agent, or Firm*—Rankin, Hill & Clark LLP

(57) ABSTRACT

The present invention provides a transformable toy capable of being transformed from a doll robot toy into a compact figure. Each of leg sections 11 of the doll robot toy 1 has a knee-position connecting mechanism 23 for connecting a thigh section 11*a* and a shin section 11*b* and an ankle-position connecting mechanism 27 for connecting the shin section 11*b* and a foot section 11*c*. The knee-position connecting mechanism 23 is constructed so as to allow a calf portion of the shin section 11*b* to be placed adjacent to the rear side of the thigh section 11*a*. The ankle-position connecting mechanism 27 is constructed so as to allow a sole portion of the foot section 11*c* to be placed adjacent to the back side of the body section 5 of the doll robot toy.

7 Claims, 21 Drawing Sheets

FOREIGN PATENT DOCUMENTS

| | | | | |
|---|---|---|---|---|
| JP | 62-133692 | | | 8/1987 |
| JP | 63-22986 | | | 2/1988 |
| JP | 7-250972 | | | 10/1995 |
| JP | 9-10442 | | | 1/1997 |
| JP | 09010442 | A | * | 1/1997 |
| JP | 09010442 | A | * | 1/1997 |
| JP | 9-28933 | | | 2/1997 |
| JP | 09028933 | A | * | 2/1997 |
| JP | 09028933 | A | * | 2/1997 |

* cited by examiner

TRANSFORMABLE TOY

TECHNICAL FIELD

The present invention relates to a transformable toy which is transformed from a robot toy of a certain figure to a robot toy of another figure.

BACKGROUND ART

Japanese Patent Application Laid-Open No. Hei 9-10442 and Japanese Patent Application Laid-Open No. Hei 9-28933 etc disclose conventional arrangements of transformable toys of which figure is transformed from a figure of a vehicle or an animal into a doll robot toy. Various kinds of transformable toys are sold in the market. In these conventional transformable toys, in order to transform the figure, a various kinds of joint structures are employed.

Patent document 1: Japanese Patent Application Laid-Open No. 10442/1997

Patent document 2: Japanese Patent Application Laid-Open No. 28933/1997

DISCLOSURE OF THE INVENTION

Problem to be Solved by the Invention

However, in the structure of conventional transformable toys, there resides such disadvantage that, when transforming a doll robot toy into a robot toy of another figure, the entire shape and dimensions are hardly compacted. In particular, in the case where the figure is transformed into a quite different figure, it is necessary to store a large part of the doll robot toy within a transformed external case. In this case, the doll robot toy has to be transformed into a compact shape so as to be received within the external case.

An object of the invention is to provide a transformable toy capable of transforming the doll robot toy into a compact figure.

Another object of the invention is to provide a transformable toy capable of transforming its figure between a marine mammal robot toy and a doll robot toy.

Further, another object of the invention is to provide a transformable toy in which a small number of component parts constitute the exterior of the marine mammal robot toy.

Still further, another object of the invention is to provide a transformable toy, in which a part of the exterior of the marine mammal robot toy can be utilized as a part of the doll robot toy; or, a shield or an arm.

Another object of the invention is to provide a transformable toy, in which a tail section of the marine mammal robot toy can be transformed compactly.

Another object of the invention is to provide a transformable toy of which figure is transformed between a bird-like robot toy such as a bird and the doll robot toy.

Means for Solving the Problems

The object of the present invention is to improve a transformable toy of which a figure is transformed between a doll robot toy and a robot toy of another figure. In the present invention, the doll robot toy comprises a pair of leg sections, each of the leg sections comprising: a thigh section, a shin section and a foot section, a knee-position connecting mechanism for connecting the thigh section and the shin section, and an ankle-position connecting mechanism for connecting the shin section and the foot section. The knee-position connecting mechanism is constructed so as to allow a calf portion of the shin section to be placed adjacent to the rear side of the thigh section, and the ankle-position connecting mechanism is constructed so as to allow a sole portion of the foot section to be placed adjacent to a back side of the body section of the doll robot toy. By arranging as described above, the section lower than the knee of the leg section can be folded along a rear side of the thigh section and a back side of the body section of the doll robot toy. Owing to this, when transforming from the doll robot toy into the other robot toy, the long legs of the doll robot toy are not large obstacle for its transformation. Thus, the figure of the transformed robot toy can be compacted. In particular, even when the figure of the transformed robot toy has an exterior, and when at least a part of the doll robot toy has to be received inside the exterior, the figure of the transformed robot toy can be compacted.

The knee-position connecting mechanism may include a connecting link connected to the thigh section and the shin section respectively with turning pairs respectively (rotatably connecting to allow a rotation on an axle). In this case, a length of the connecting link is predetermined so as to allow a calf portion to be placed adjacent to the rear side of the thigh section. By employing the connecting link and the turning pair as described above, the shin section can be reliably placed adjacent to the rear side of the thigh section (including both of contact with and approximation to each other).

Also, the ankle-position connecting mechanism connects the shin section and the foot section with a turning pair and may be constructed so as to allow the foot section and the shin section to be aligned on a substantially straight line. By employing the above structure, the foot section also can be reliably placed adjacent to the back side of the body section of the doll robot toy (including both of contact with and approximation to each other).

The present invention is applicable to a transformable toy of which a figure is transformed between a marine mammal robot toy such as a whale and a doll robot toy. The marine mammal robot toy has a head section, a body section and a tail section. The doll robot toy has a head section, a body section, a pair of arm sections and a pair of leg sections. Each of the leg sections of the doll robot toy includes a thigh section, a shin section, a foot section, a knee-position connecting mechanism for connecting the thigh section and the shin section, and an ankle-position connecting mechanism for connecting the shin section and the foot section. The knee-position connecting mechanism is constructed so as to allow a calf portion of the shin section to be placed adjacent to the rear side of the thigh section, and the ankle-position connecting mechanism is constructed so as to allow a sole portion of the foot section to be placed adjacent to the back side of the body section of the doll robot toy. The pair of leg sections of the doll robot toy is received within the head section of the marine mammal robot toy in a state that the calf portion is placed adjacent to the rear side of the thigh section, and that the sole portion of the foot section is placed adjacent to the back side of the body section of the doll robot toy. The head section of the doll robot toy is received within the body section of the marine mammal robot toy. At least a part of the head section and the body section of the marine mammal robot toy is dividably constructed so that, when the marine mammal robot toy is transformed into the doll robot toy, the pair of leg sections and the head section of the doll robot toy received therein may be exposed to an outside. The tail section of the marine mammal robot toy is foldably constructed and mounted onto the back side of the body section of the doll robot toy.

By arranging as described above, the leg sections having a large shape can be received easily inside the marine mammal robot toy. Also, by arranging a part of the head section and body section of the marine mammal robot toy dividably, not only that the leg sections of the doll robot toy can be received easily but also taken out easily. Further, by arranging the tail section of the marine mammal robot toy foldably, the tail section can be utilized as a part for forming the part of the doll robot toy without removing the tail section.

By arranging so that a part of the body section and a part of the arm section of the doll robot toy to form a part of the body section of the marine mammal robot toy, the number of component parts necessary for forming the exterior of the marine mammal robot toy can be reduced.

A part of the body section of the marine mammal robot toy is constituted from a pair of body-section forming outer-shell members, the pair of body-section forming outer-shell members, and an outer-shell member connecting mechanism for connecting the pair of body section forming outer-shell members to the body section of the doll robot toy in such a manner that the pair of body-section forming outer-shell members are moved left and right respectively. When divided, the pair of body-section forming outer-shell members are separated right and left as viewed from the front, and adopted to constitute the part of the body section by moving the body-section forming outer shell members close to each other. By employing such arrangement that the pair of the body section outer shells is connected to the body section of the doll robot toy with the outer-shell member connecting mechanism, the pair of body section outer shells can be utilized as a guard means (shield, weapon or the like) for the doll robot toy.

Further, the head section of the marine mammal robot toy is constituted from a pair of head-section forming outer-shell members, and outer-shell member connecting mechanism for connecting the pair of head-section forming outer shell members to the body section of the doll robot toy in such a manner that the pair of head-section forming outer-shell members are moved left and right respectively. As described above, by employing such arrangement that the pair of head section forming outer shell member is connected to the body section of the doll robot toy with the outer-shell member connecting mechanism, the pair of head section forming outer shell member can be utilized as a guard means (shield, weapon or the like) for the doll robot toy.

The pair of head-section forming outer-shell members may be shaped so as to form an opening for exposing a part of the pair of leg sections. In this case, the head section of the marine mammal robot toy further includes a cover member for covering the opening. The cover member is preferably constructed so as to be used as a weapon or shield for the doll robot toy. As described above, by arranging the pair of head-section forming outer-shell members so as to form the opening, the pair of leg sections can be taken out and received through the opening. Thus, the transformation operation can be carried out more smoothly. In addition to that, by using the cover member for covering the opening as an weapon or shield, the parts necessary for forming the marine mammal robot toy can be utilized as accessories for the doll robot toy. Also, in the case where the marine mammal robot toy has a pair of detachable flipper sections, the pair of flipper sections is constructed so as to be used as a weapon for the doll robot toy. By arranging the parts as described above, the utilization ratio thereof can be increased.

Also, when the present invention is applied to a transformable toy of which a figure is transformed between a bird-like robot toy such as a bird and a doll robot toy, an effect of compaction can be obtained. In this case, the bird-like robot toy comprises a head section, a body section, a tail section and wing sections; and the doll robot toy comprises a head section, a body section, a pair of arm sections and a pair of leg sections. In this case also, each of the leg sections of the doll robot toy includes a thigh section, a shin section, a foot section, a knee-position connecting mechanism for connecting the thigh section and the shin section, and an ankle-position connecting mechanism for connecting the shin section and the foot section. The knee-position connecting mechanism is constructed so as to allow a calf portion of the shin section to be placed adjacent to a rear side of the thigh section, and the ankle-position connecting mechanism is constructed so as to allow a sole portion of the foot section to be placed adjacent to the back side of the body section of the doll robot toy. The pair of leg sections of the doll robot toy form the tail section of the bird-like robot toy in a state that the calf portion is placed adjacent to the rear side of the thigh section, and that the sole portion of the foot section is placed adjacent to the back side of the body section of the doll robot toy. A mounting structure of the head section of the doll robot toy is constructed so that the head section of the doll robot toy may be received within the body section of the bird-like robot toy. The wing sections of the bird-like robot toy are foldably constructed and mounted onto the back side of the body section of the doll robot toy.

BEST MODE FOR CARRYING OUT THE INVENTION

Figure 1:
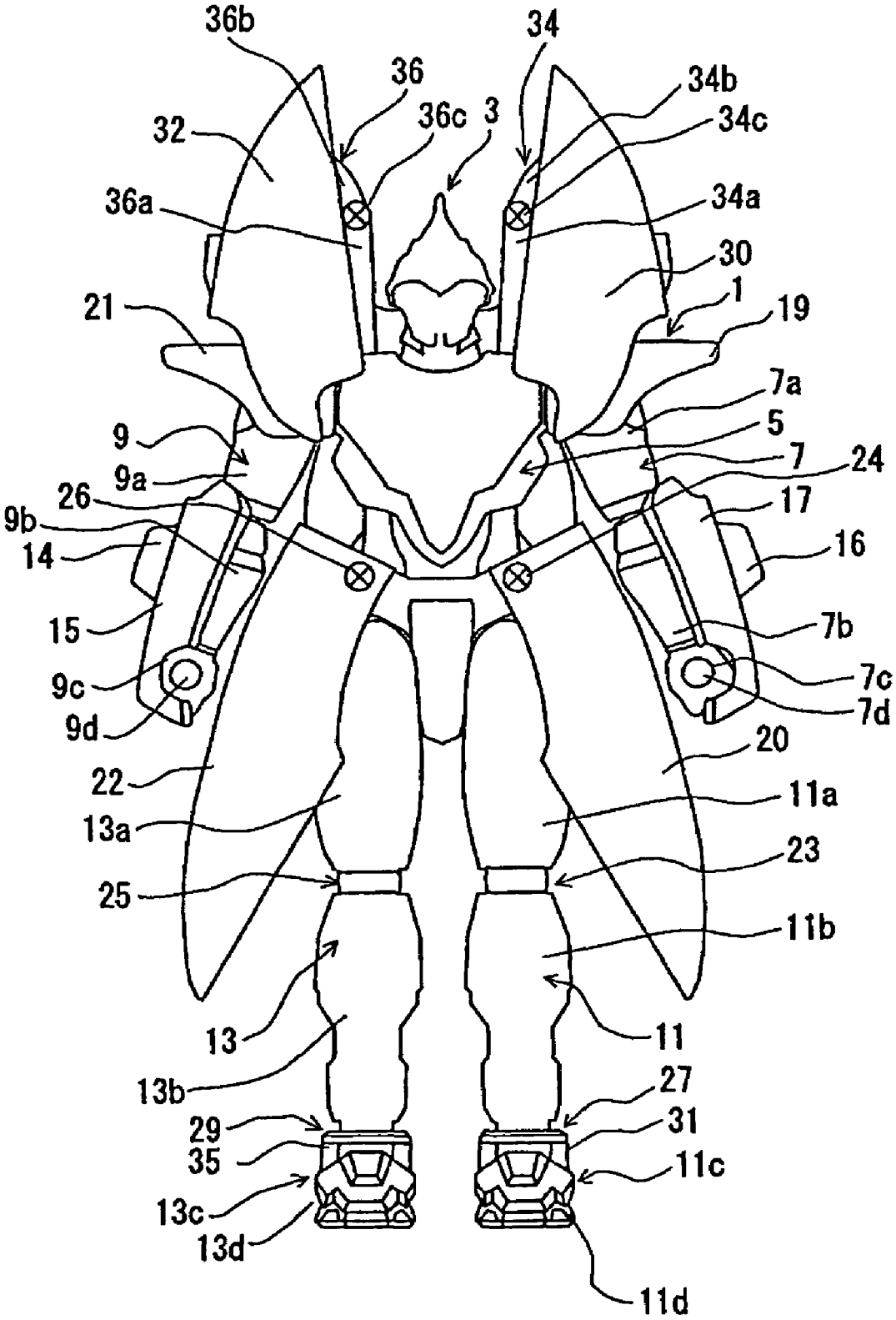
FIG. 1 is a front elevation view of a transformable toy in a figure of a doll robot toy according to an embodiment of the present invention.
Figure 2:
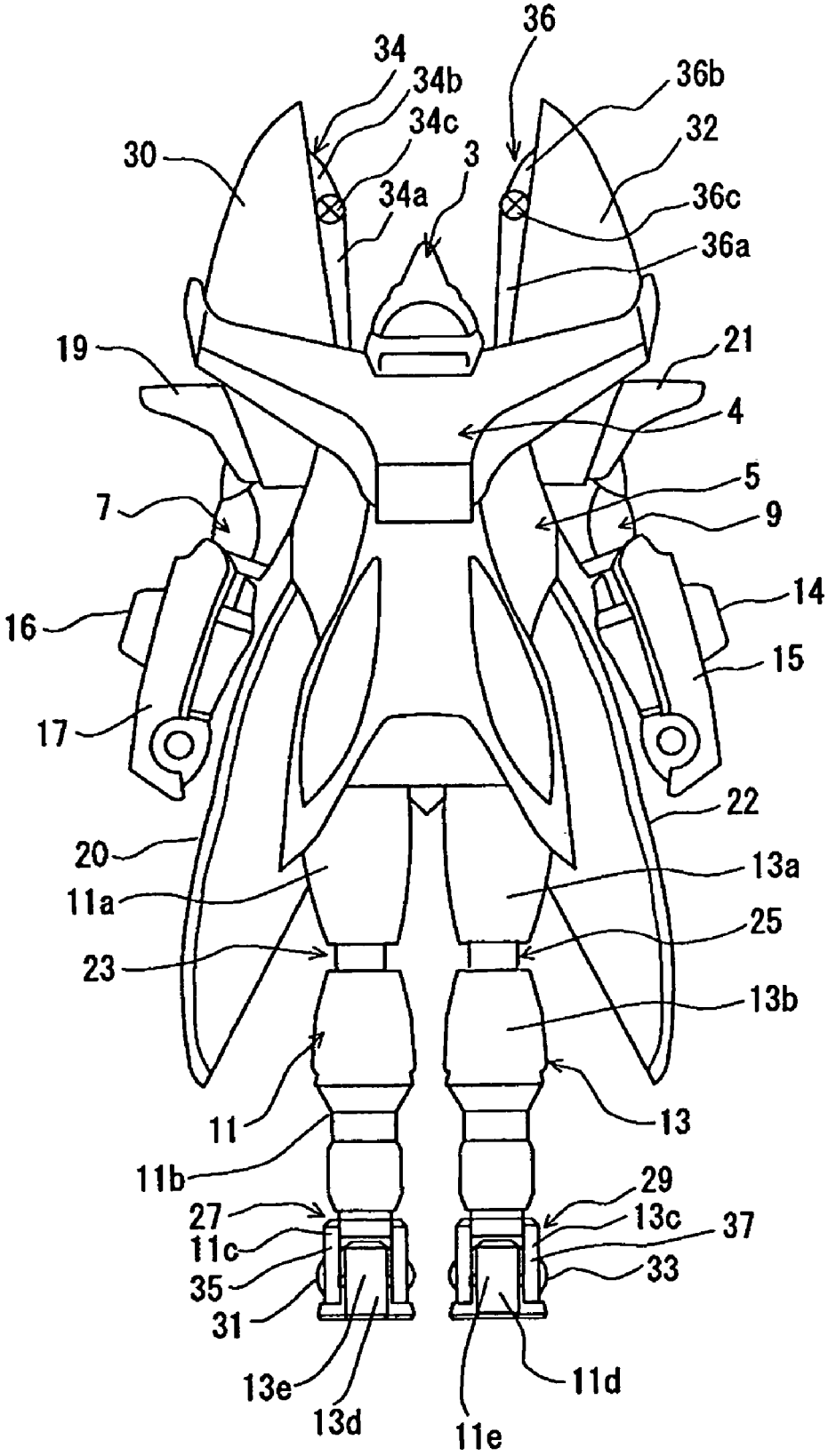
FIG. 2 is a rear elevation view of a transformable toy in a figure of a doll robot toy according to the embodiment of the present invention.
Figure 3:
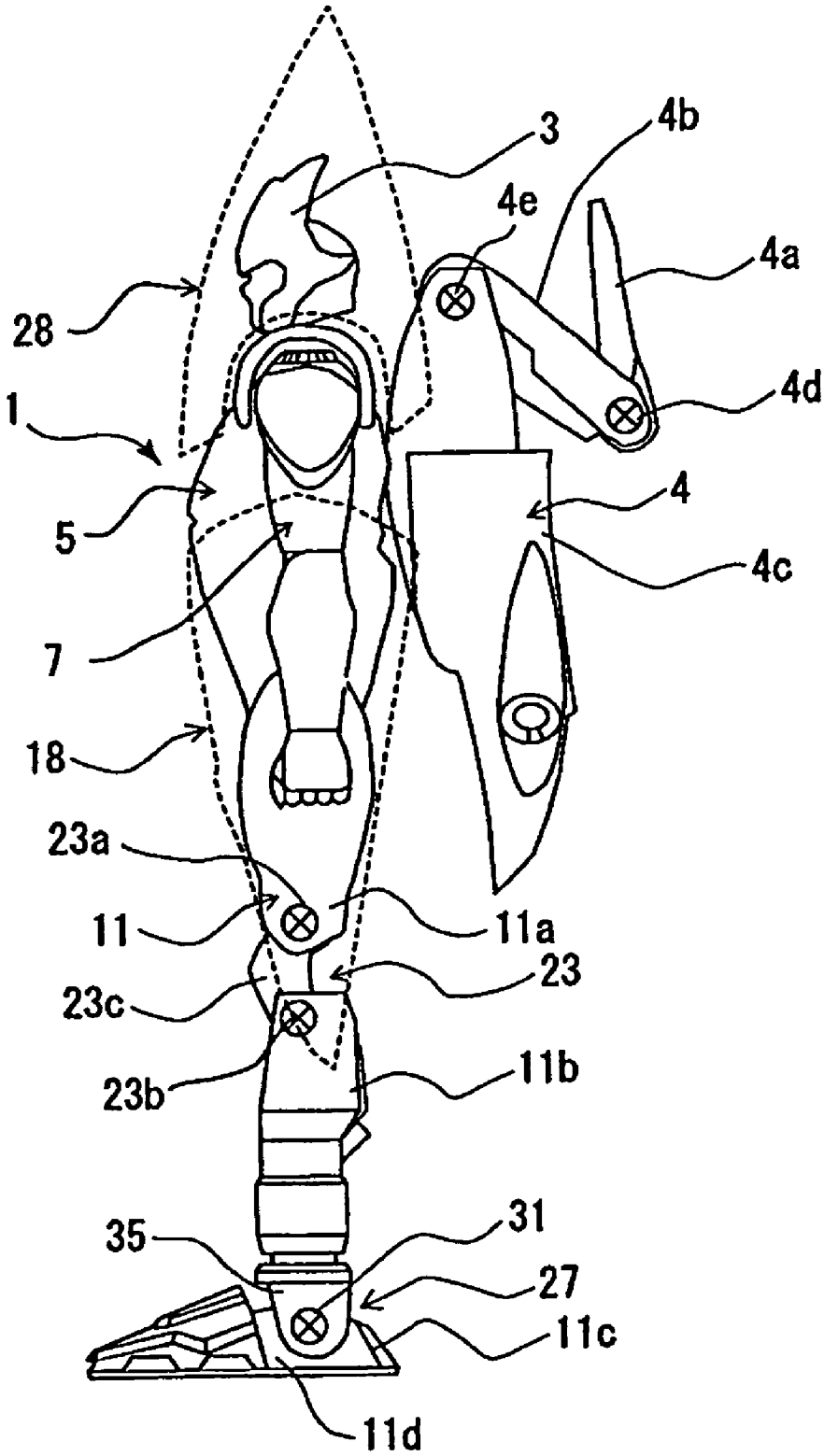
FIG. 3 is a right side elevation view of a transformable toy in a figure of a doll robot toy according to the embodiment of the present invention, a part of which is omitted.
Figure 4:
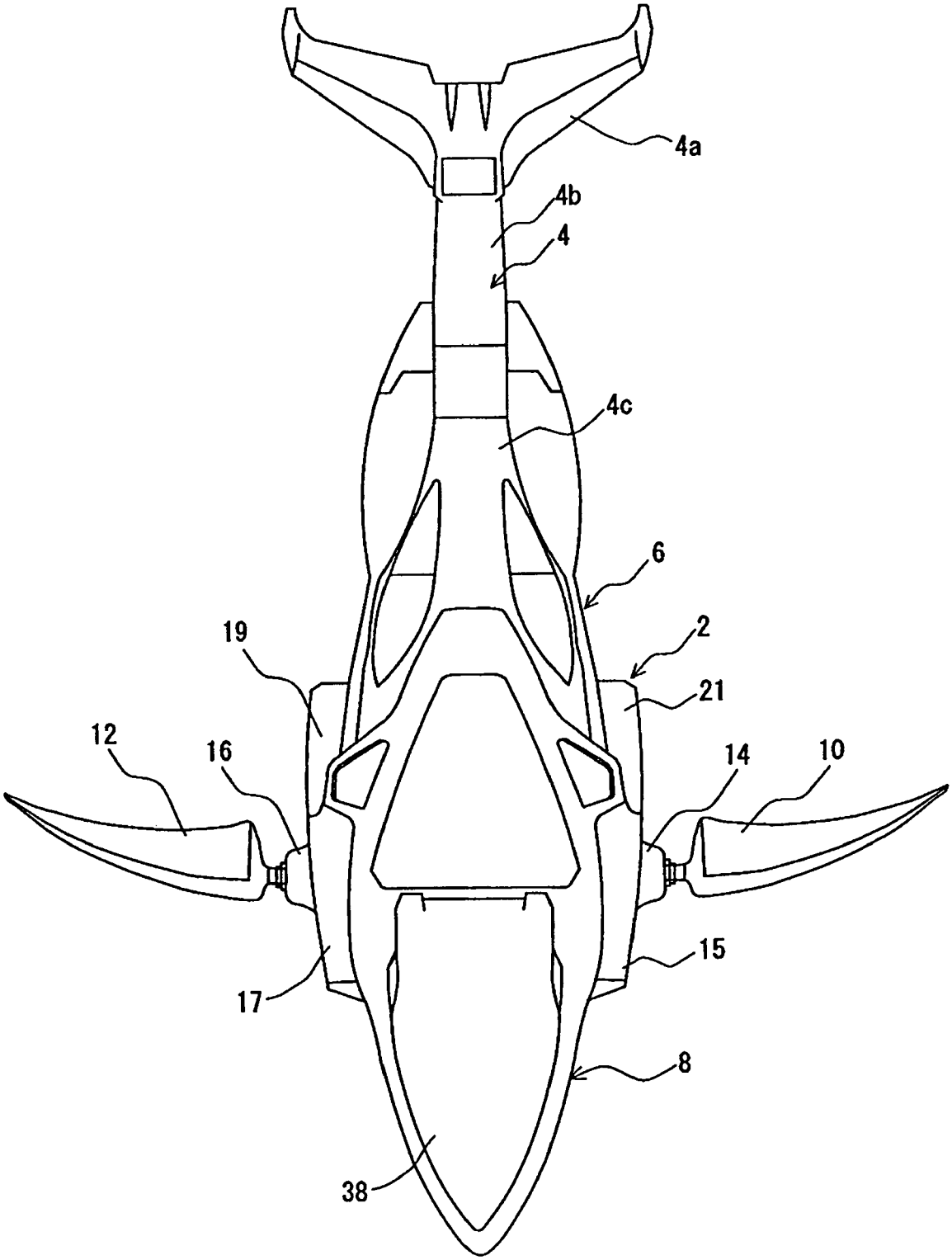
FIG. 4 is a schematic plane view of a transformable toy in a figure of a marine mammal robot toy according to the embodiment of the present invention.
Figure 5:
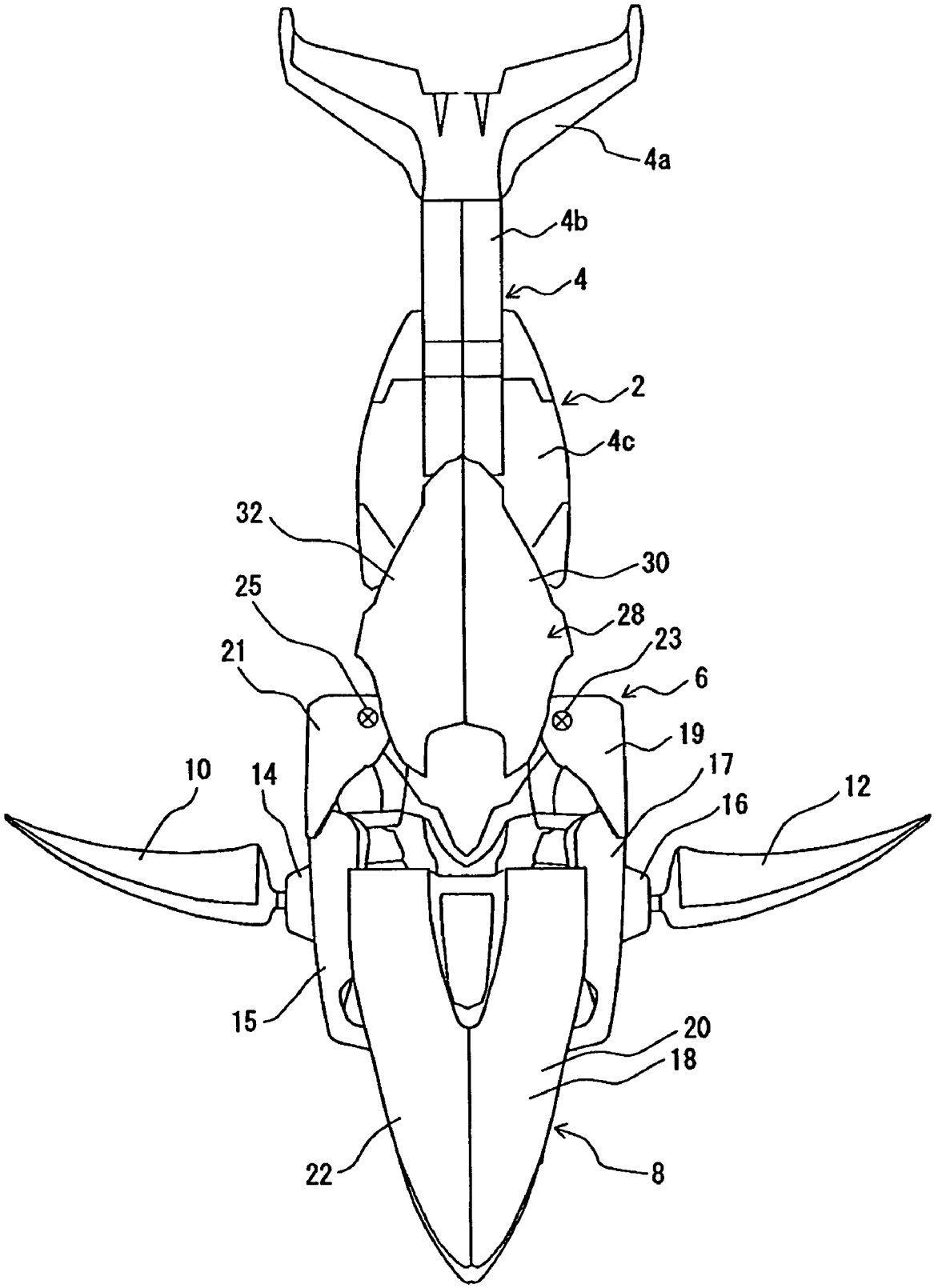
FIG. 5 is a schematic bottom plane view of a transformable toy in a figure of a marine mammal robot toy according to the embodiment of the present invention.
Figure 6:
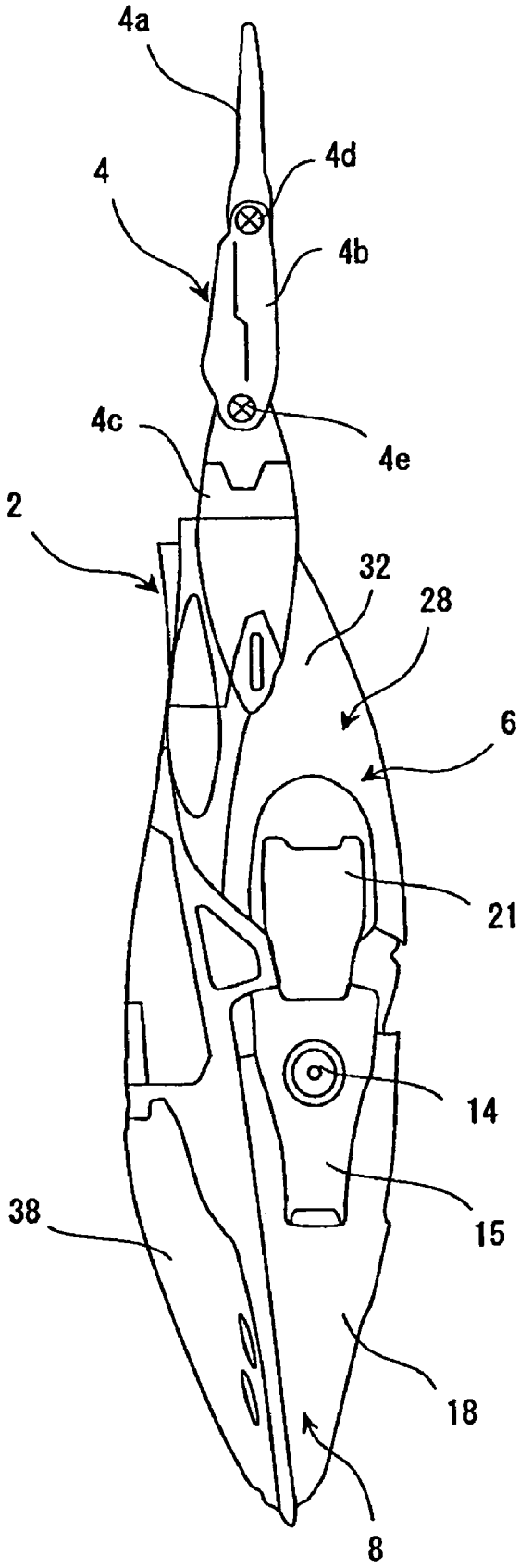
FIG. 6 is a schematic right side elevation view of a transformable toy in a figure of a marine mammal robot toy according to the embodiment of the present invention.

Hereinafter, an example of an embodiment of a transformable toy according to the present invention will be described in detail with reference to the drawings. FIGS. 1, 2 and 3 are a front elevation view, a rear elevation view, and a right side elevation view, a part of which is omitted, when the transformable toy of the embodiment is a doll robot toy 1. In FIG. 3, in order to facilitate understanding of the embodiment, a part, which is hindrance to illustration, is omitted. FIGS. 4, 5 and 6 are a schematic plane view, a schematic bottom plane view and a schematic right side elevation view, respectively, when the transformable toy of the embodiment is a marine mammal robot toy 2. In the transformable toy, the main part of the doll robot toy 1 is received within the marine mammal robot toy 2.

The doll robot toy 1 shown in FIGS. 1 to 3 has a head section 3, a body section 5, a pair of arm sections 7 and 9, and a pair of leg sections 11 and 13. The head section 3 of the doll robot toy 1 is connected to the body section 5. In the rear side (back) of the body section 5, a tail section 4 of the marine mammal robot toy 2 is mounted, being folded.

A pair of arm sections 7 and 9 of the doll robot toy 1 are mounted onto the shoulders of the body section 5 with a joint structure (not shown) respectively. Each of the arm sections 7 and 9 includes an upper arm section 7*a*, 9*a*, a lower arm section 7*b*, 9*b* and a hand section 7*c*, 9*c*. The joint structure (not shown) has a well-known structure, which allows the upper arm sections 7*a* and 9*a* to move backward and forward as well as rightward and leftward. Also, a joint structure (not shown) between the upper arm section 7*a*, 9*a* and the lower arm section 7*b*, 9*b* has a well-known structure, which allows the lower arm section 7*b*, 9*b* to move backward and forward with respect to the upper arm section 7*a*, 9*a*, or allows the lower arm section 7*b*, 9*b* to rotate backward and forward within a predetermined angular range on the lower end portion of the upper arm section 7*a*, 9*a*. In addition to the above, the joint structure has a well-known structure, which allows the lower arm section 7*b*, 9*b* to rotate within a predetermined angular range around the centerline which goes through the center of the upper arm section 7*a*, 9*a*, with respect to the upper arm section 7*a*, 9*a*. Arm guards 15 and 17 are provided outside the lower arm sections 7*b* and 9*b*. Provided in the arm guards 15 and 17 are attachments 14 and 16 for detachably attaching flipper sections 10 and 12 of the marine mammal robot toy 2.

Shoulder guards 19 and 21 are rotatably mounted onto the shoulders of the body section 5 of the doll robot toy 1. When the doll robot toy 1 is transformed into the marine mammal robot toy 2, each of the shoulder guards 19 and 21 is, from a state shown in FIG. 1, rotated on a rotation axle (not shown) so as to be positioned along the upper arm sections 7*a* and 9*a* of the both arm sections. A section of the arm guards 15 and 17, the shoulder guards 19 and 21 and the pair of arm sections 7 and 9 form a part of the exterior of the body section of the marine mammal robot toy 2.

A pair of leg sections 11 and 13 have thigh sections 11*a* and 13*a*, which are mounted onto the body section 5 with a joint structure (not shown) respectively, shin sections 11*b* and 13*b* and foot sections 11*c* and 13*c*. The pair of leg sections 11 and 13 have knee-position connecting mechanisms 23 and 25 for connecting the thigh section and the shin section respectively, and ankle-position connecting mechanisms 27 and 29 for connecting the shin section 11*b* and the foot section 11*c* respectively. Since the structure of the pair of leg sections 11 and 13 is identical, the structure of the leg section 11 will be hereinafter described with reference to FIG. 3. The knee-position connecting mechanism 23 includes a connecting link 23*c* connected to the thigh section 11*a* and the shin section 11*b* with a turning pairs 23*a*, 23*b* respectively. The turning pairs 23*a* and 23*b* connect the end portions of the connecting link 23*c* to the thigh section 11*a* and the shin section 11*b* rotatably on the axle respectively. The length and shape of the connecting link 23*c* of the knee-position connecting mechanism 23 is predetermined to a length which allows the calf portion of the shin section 11*b* to be placed adjacent to the rear side of the thigh section 11*a* (they are brought into contact with or positioned adjacent to each other). By employing the connecting link 23*c* and the turning pairs 23*a* and 23*b* as described above, the shin section 11*b* can be reliably placed adjacent to the rear side of the thigh section 11*a*.

The ankle-position connecting mechanism 27 is constructed so that the shin section 11*b* and the foot section 11*c* are connected to each other with a turning pair 31. Therefore, the foot section 11*c* rotates on the turning pair 31 within a predetermined angular range. The ankle-position connecting mechanism 27 is constructed so as to allow the foot section 11*c* and the shin section 11*b* to be aligned on a substantially straight line. To be more precise, as shown in FIG. 2, in the shin sections 11*b* and 13*b*, an axle constituting the turning pair 31, 33 is fixed to an angles 35, 37 having a U-like shape, respectively, which rotates around the centerline extending in the direction where the shin section 11*b*, 13*b* extends. Mounted onto these axles rotatably within a predetermined angle are plate-like sections 11*e* and 13*e* formed integrally with the foot section bodies 11*d* and 13*d*. This predetermined angle is an angle, which allows the foot section 11*c* and the shin section 11*b* to be aligned on a substantially straight line.

Figure 7:
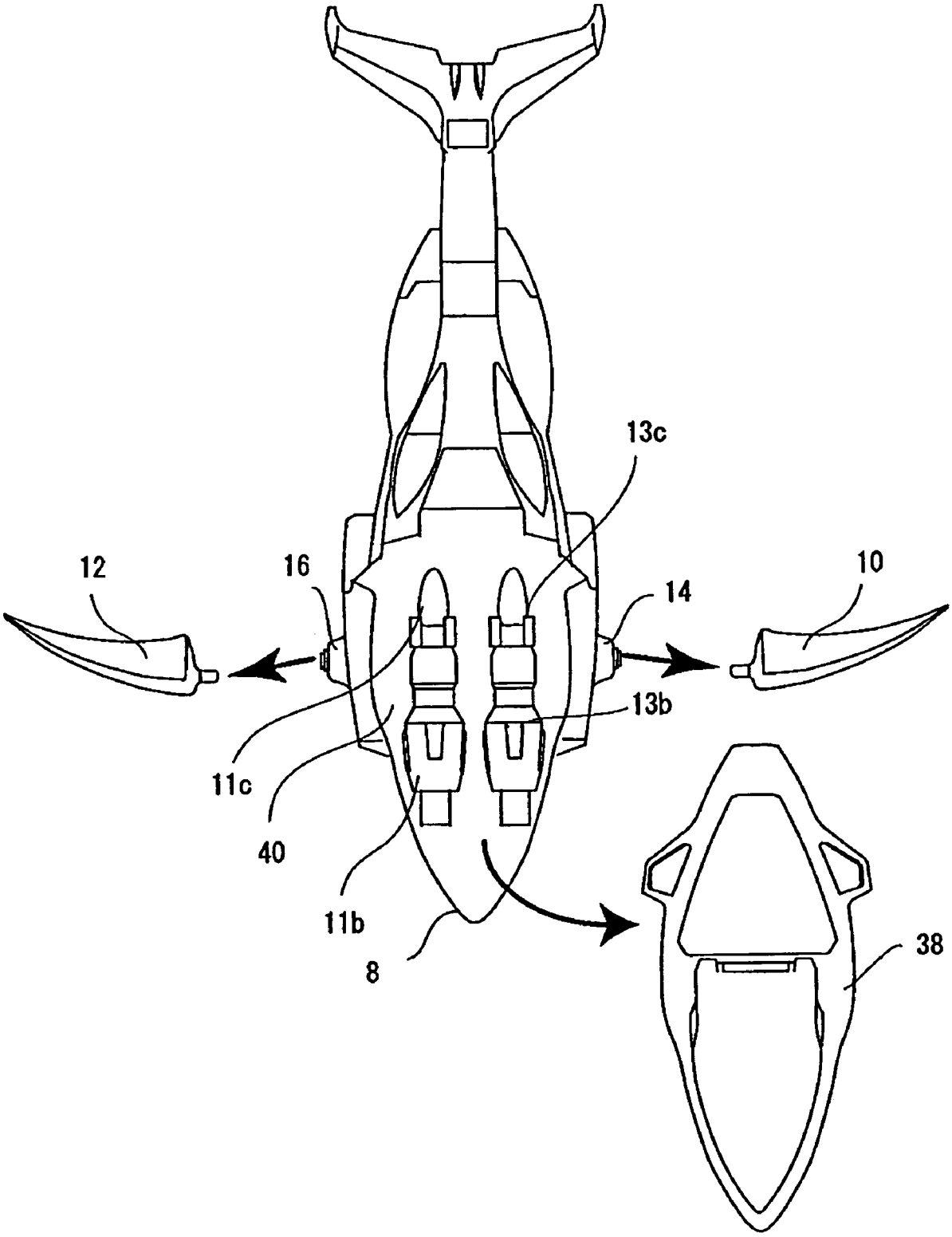
FIG. 7 is a view showing a first step when the marine mammal robot toy is transformed into the doll robot toy.

Mounted onto the body section 5 of the doll robot toy 1 movably rightward and leftward with turning pairs 24 and 26 constituting an outer-shell member connecting mechanism are a pair of head-section forming outer-shell members 20 and 22, which form a lower part 18 of a head section 8 of the marine mammal robot toy 2. As the doll robot toy 1 is viewed from the front, the pair of head-section forming outer-shell members 20 and 22 are separated apart right and left from each other; and when the both are brought closer to each other, a portion (lower part 18) of the head section 8 of the marine mammal robot toy 2 is formed. An upper part 38 of the head section 8 of the marine mammal robot toy 2, which will be described below, is constructed so as to be detachable as shown in FIG. 7. The upper part 38 of the head section 8 is constructed so as to cover an opening 40 of the lower part 18 of the head section 8 of the marine mammal robot toy 2, which is constituted from the pair of head-section forming outer-shell members 20 and 22. The upper part 38 of the head section 8 is fixed to the lower part 18 using a mounting structure.

As viewed from the front, the body section 5 of the doll robot toy 1 is separated apart right and left. By bringing the both closer to each other, a pair of body-section forming outer-shell members 30 and 32, which form a portion (abdominal portion at the tail section side) 28 of the body section of the marine mammal robot toy 2, are connected to each other with outer-shell member connecting mechanisms 34 and 36. These outer-shell member connecting mechanisms 34 and 36 have the following structure: two pair of links 34*a* and 34*b*, 36*a* and 36*b* are rotatably connected to each other with turning pairs 34*c* and 36*c*. The outer ends of the links 34*a* and 36*a* are connected to the back portion of the body section 5 with a link 41 (FIG. 14), which will be described later. Also, the outer ends of the link 34*b* and 36*b* are connected to the inner wall of the pair of body-section forming outer-shell members 30 and 32 with a turning pair (not shown) respectively. By supporting the pair of body-section forming outer-shell members 30 and 32 using the outer-shell member connecting mechanisms 34 and 36 as described above, the pair of body-section forming outer-shell members 30 and 32 completely enclose the head section 3 of the doll robot toy 1 in a figure of the marine mammal robot toy 2, and completely expose the head section 3 in a figure of the doll robot toy 1.

As shown in FIG. 3, the tail section 4, which is mounted onto the back side of the body section 5 of the doll robot toy in a folded state, is constituted from three component parts 4*a*-4*c*. The component part 4*a* and the component part 4*b* are rotatably connected to each other with a turning pair 4*d*; and the component part 4*b* and the component part 4*c* are rotatably connected to each other with a turning pair 4*e*.

Next, referring to FIGS. 7 to 14, the transforming process from the marine mammal robot toy 2 to the doll robot toy 1 will be described. First of all, as shown in FIG. 7, the upper part 38 of the head section 8 and the flipper sections 10 and 12 are removed from the marine mammal robot toy 2. In the rear face of the upper part 38, a part, which is inserted into a hole 7*d* or 9*d* formed in the hand section of the doll robot toy 1*i* is integrally provided. When the upper part 38 is inserted into a hole 7*d* or 9*d* formed in the hand section of the doll robot toy 1, the upper part 38 can be used as a weapon or shield for the doll robot toy 1. Also, when the flipper section 10 or 12 is inserted into the hole 7*d* or 9*d* formed in the hand section 7*c* and 9*c* of the doll robot toy 1, the flipper section 10 or 12 can be used as a weapon such as a sword for the doll robot toy 1.

Figure 8:
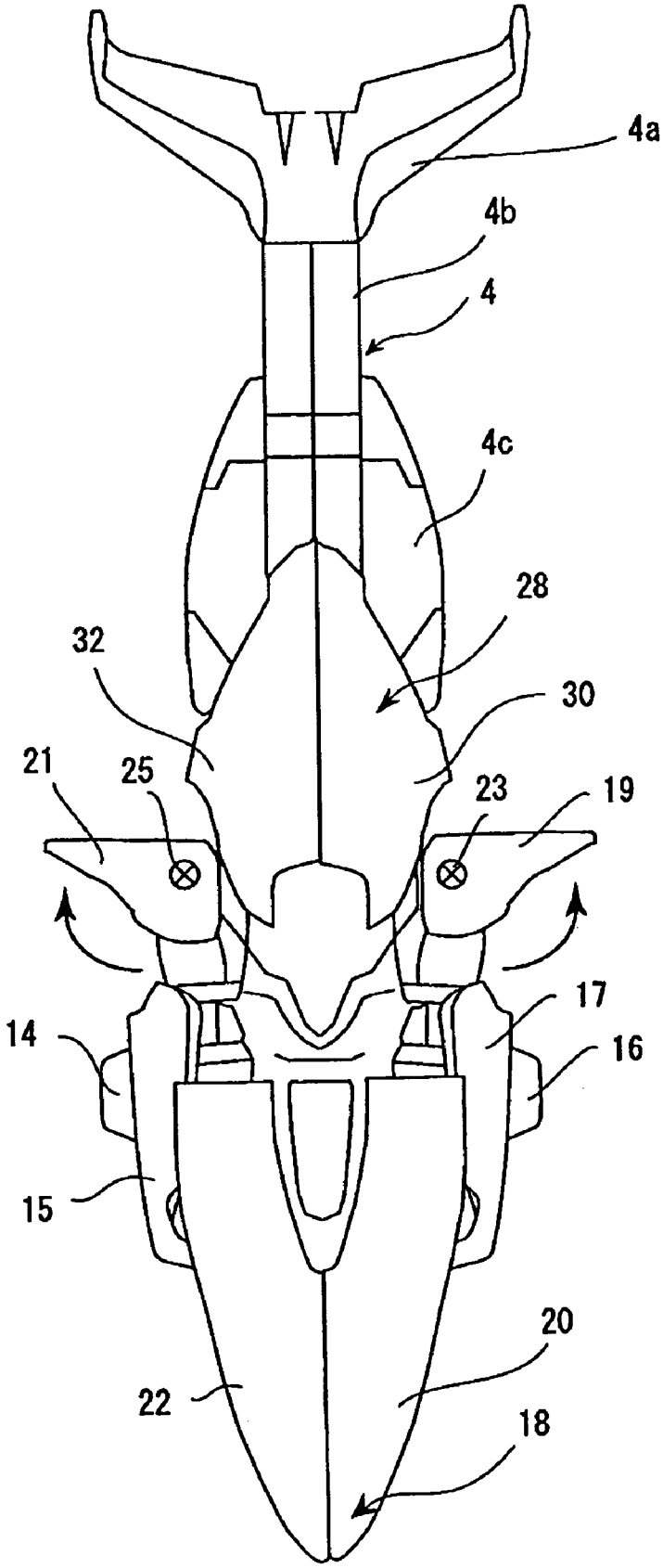
FIG. 8 is a view showing a process when the marine mammal robot toy is transformed into the doll robot toy.
Figure 9:
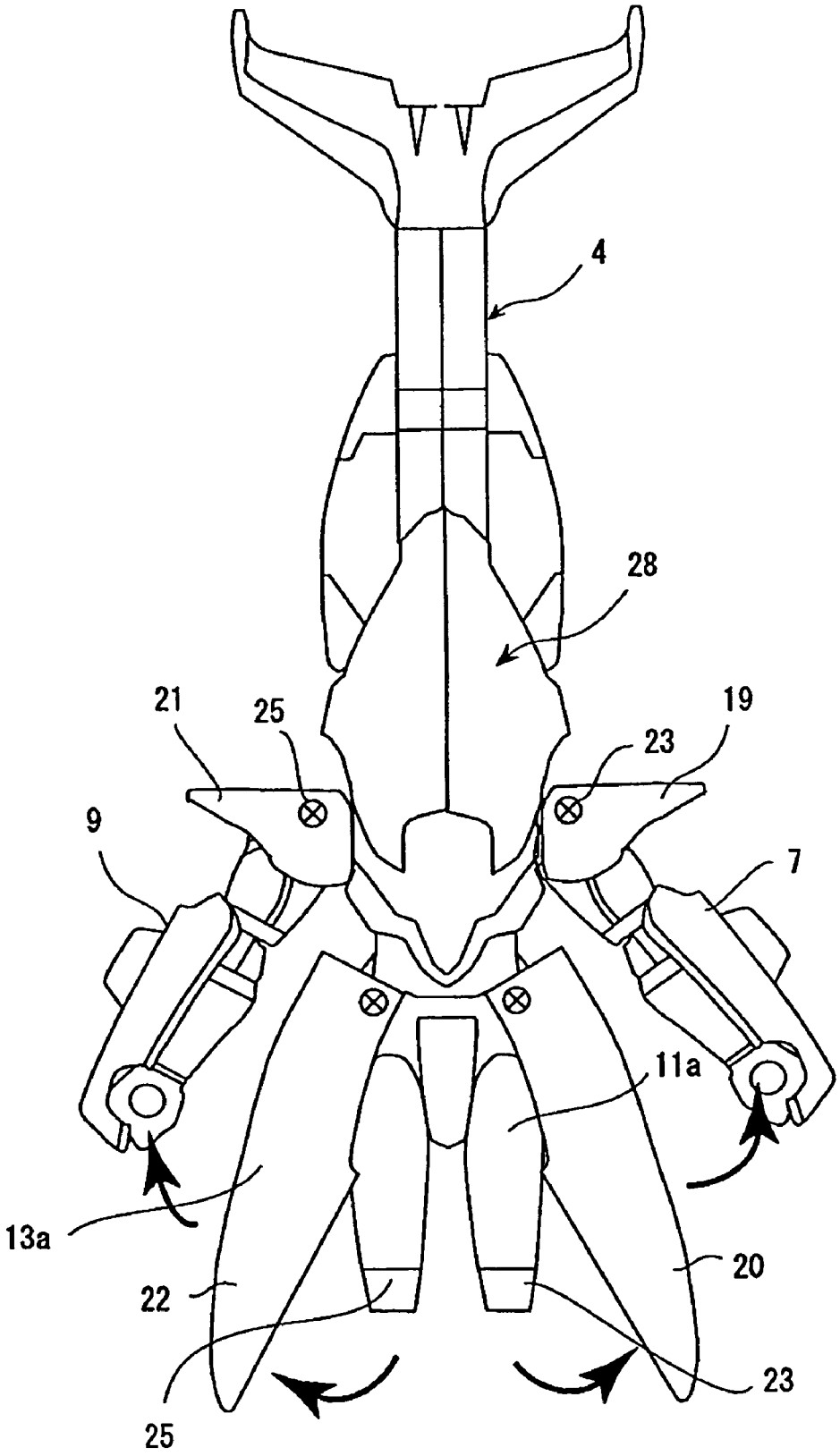
FIG. 9 is a view showing a process when the marine mammal robot toy is transformed into the doll robot toy.
Figure 10:
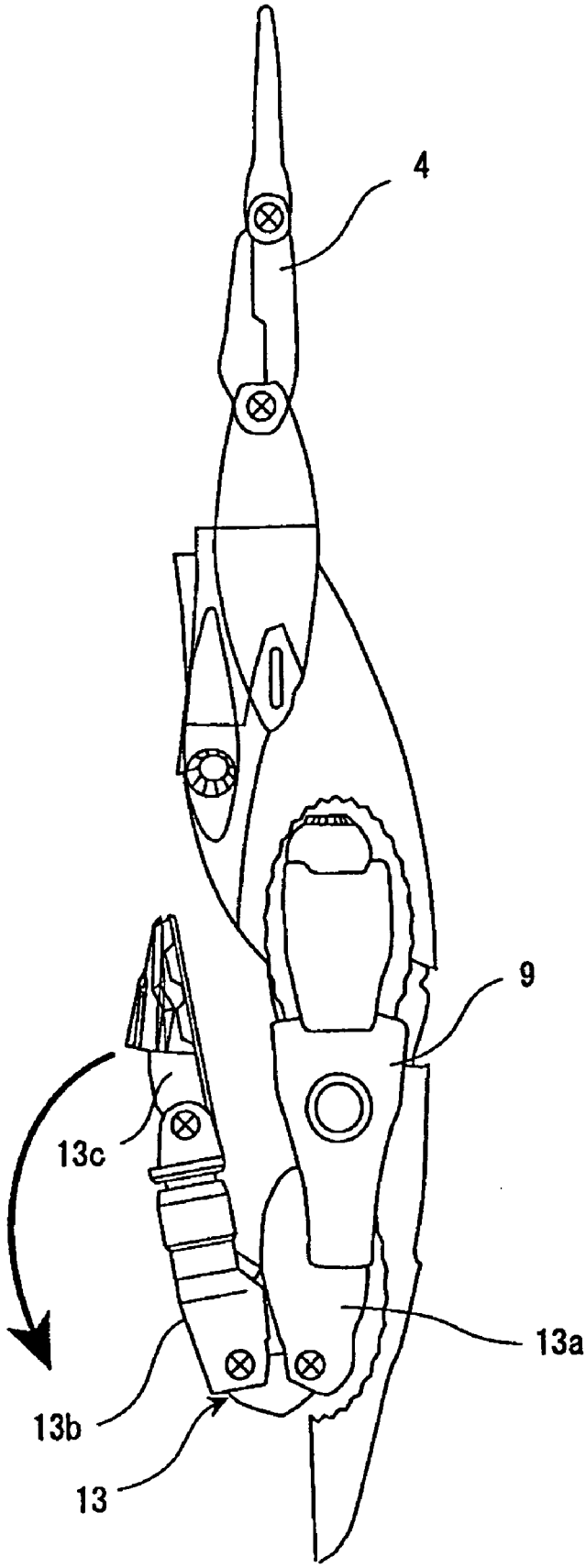
FIG. 10 is a view showing a process when the marine mammal robot toy is transformed into the doll robot toy.
Figure 11:
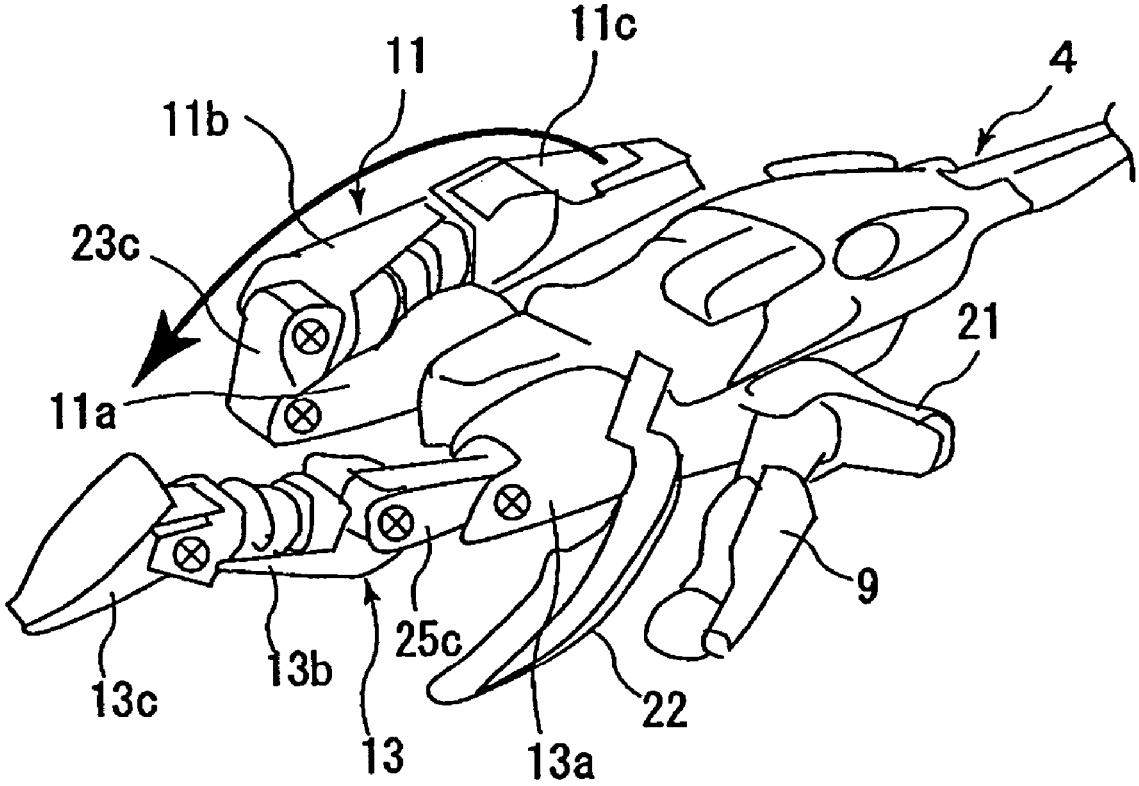
FIG. 11 is a view showing a process when the marine mammal robot toy is transformed into the doll robot toy.
Figure 12:
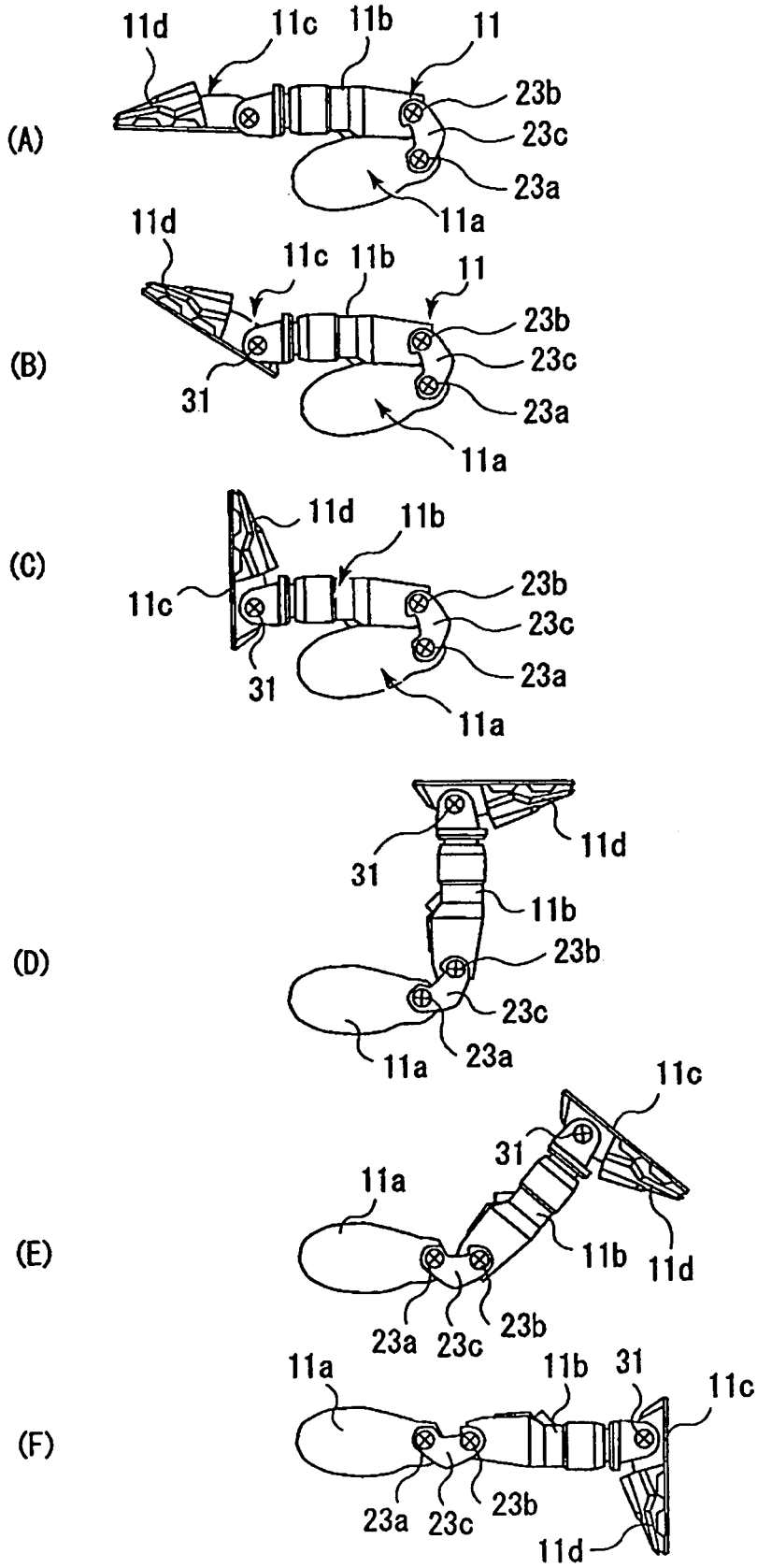
FIGS. 12(A) to (F) are illustrations, each showing a state of transformation of a member constituting a leg section, in which the leg section is transformed from a state being received in the marine mammal robot toy into a state of the leg section of the doll robot toy.

Then, as shown in FIG. 8, shoulder guards 19 and 21 are opened. And as shown in FIG. 9, after opening the pair of arm sections 7 and 9, the pair of head-section forming outer-shell members 20 and 22, which constitute the lower part 18 of the head section 8 of the marine mammal robot toy 2, are opened rightward and leftward. Then, as shown in FIG. 10 and FIG. 11, the folded right and left leg sections 11 and 13 are unfolded. FIGS. 12(A) to (F) illustrate the transformation of a member constituting the leg section 11 from the state in which leg section 11 is received in the marine mammal robot toy 2 into the state in which the leg section of the doll robot toy 1 is exposed.

Figure 13:
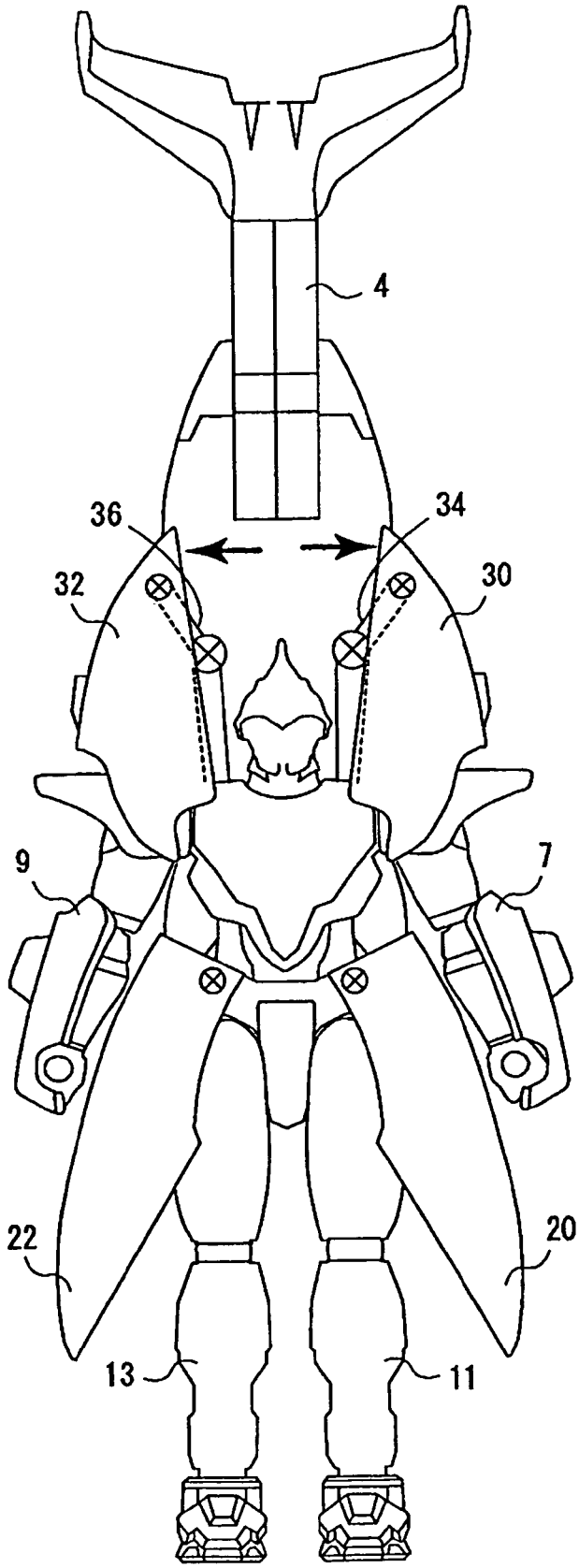
FIG. 13 is a view showing a process when the marine mammal robot toy is transformed into the doll robot toy.
Figure 14:
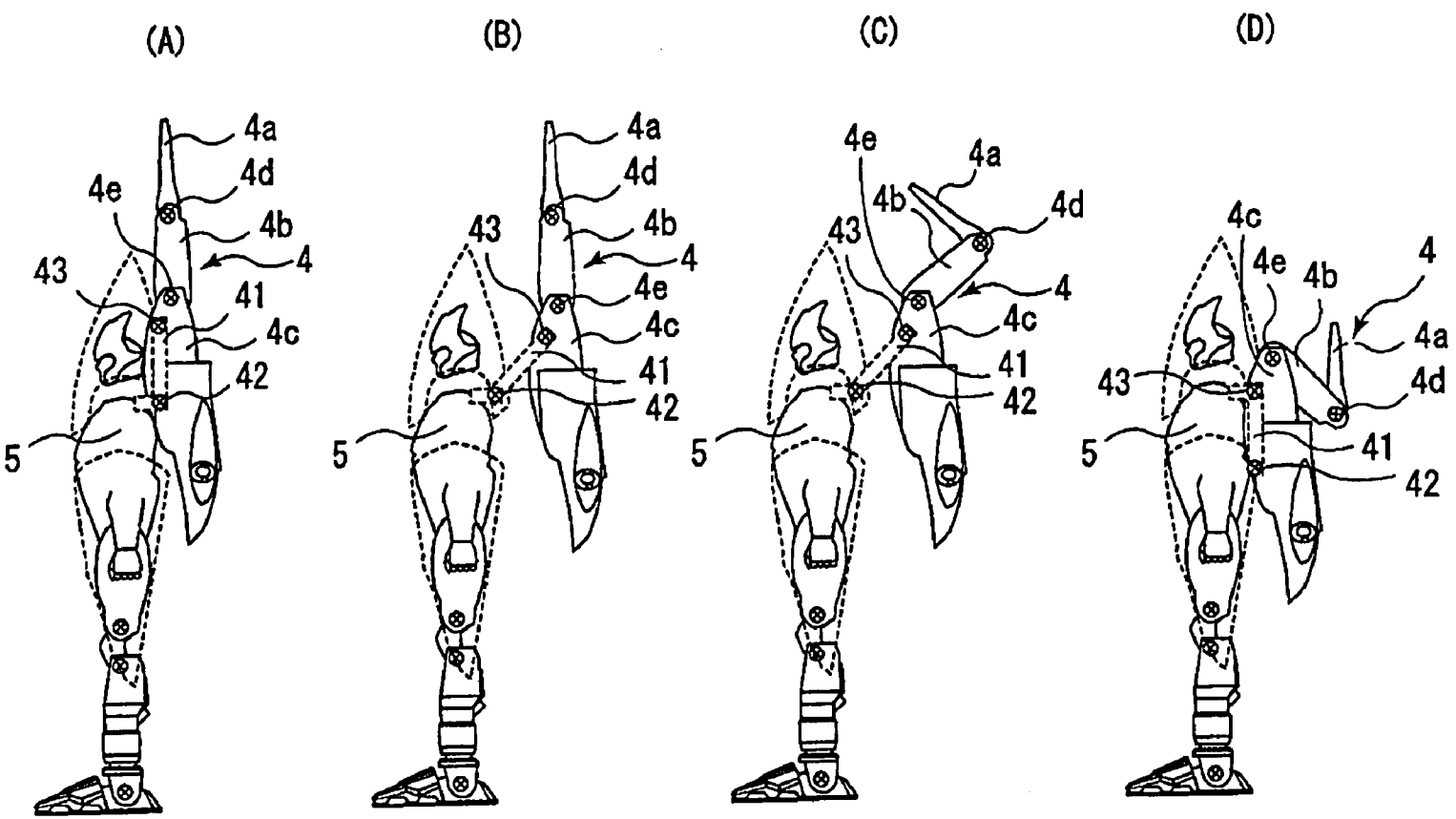
FIG. 14 is a view showing a process when the marine mammal robot toy is transformed into the doll robot toy.

After extending the two leg sections 11 and 13, the pair of body-section forming outer-shell members 30 and 32, which constitute the section (abdominal section at the tail section side) 28 of the body section of the marine mammal robot toy 2, are opened rightward and leftward as shown in FIG. 13. Finally, the tail section 4 is folded as shown in FIG. 14. As shown in FIG. 14, the component part 4*c* of the tail section 4 is mounted onto the body section 5 using the rotation link 41. The one end of the rotation link 41 is rotatably mounted onto the body section 5 with a turning pair 42; and the other end of the rotation link 41 is rotatably mounted onto the component part 4*c* with a turning pair 43. In a figure of the marine mammal robot toy 2, the rotation link 41 is oriented upward; and in a figure of the doll robot toy 1, the rotation link 41 is turned by 180° on the turning pair 43 to be oriented downward. By providing the rotation link 41 as described above, even when the tail section 4 is long, the position of the folded tail section 4 can be lowered. Therefore, the folded tail section 4 does not considerably degrade the appearance of the doll robot toy 1.

Figure 15:
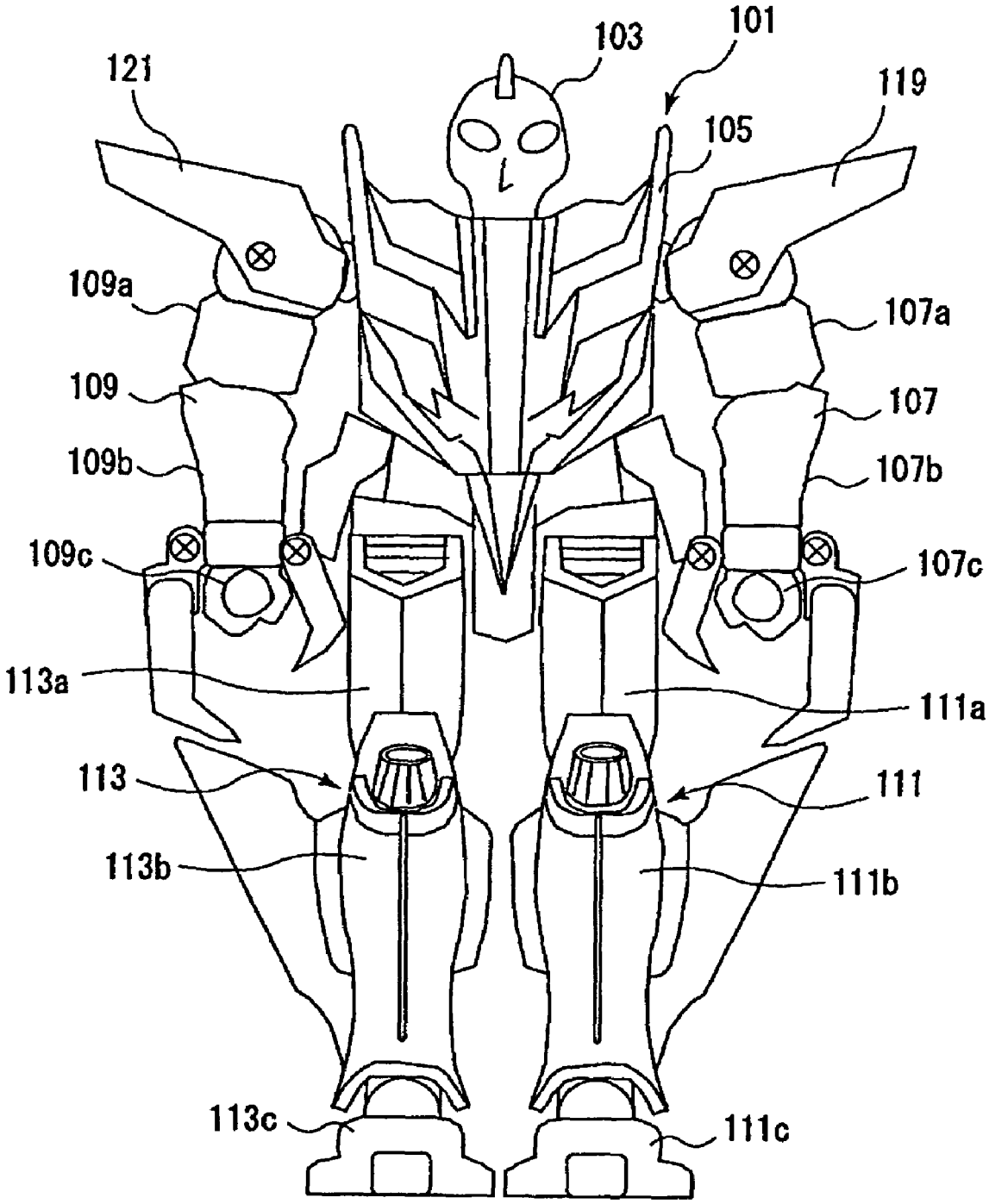
FIG. 15 is a front elevation view of a doll robot toy according to a second embodiment of the present invention.
Figure 16:
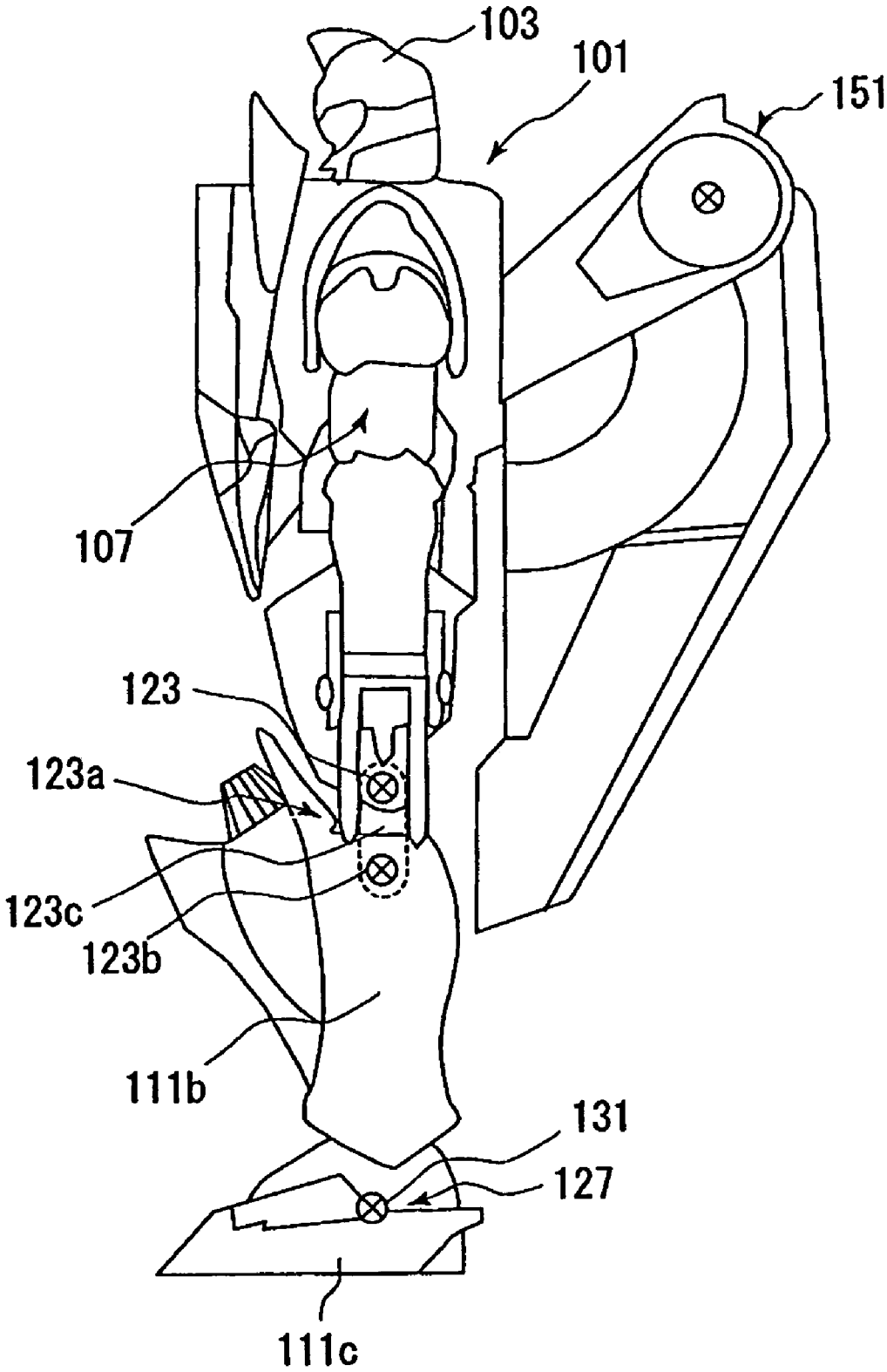
FIG. 16 is a right side elevation view of the doll robot toy according to the second embodiment of the present invention.
Figure 17:
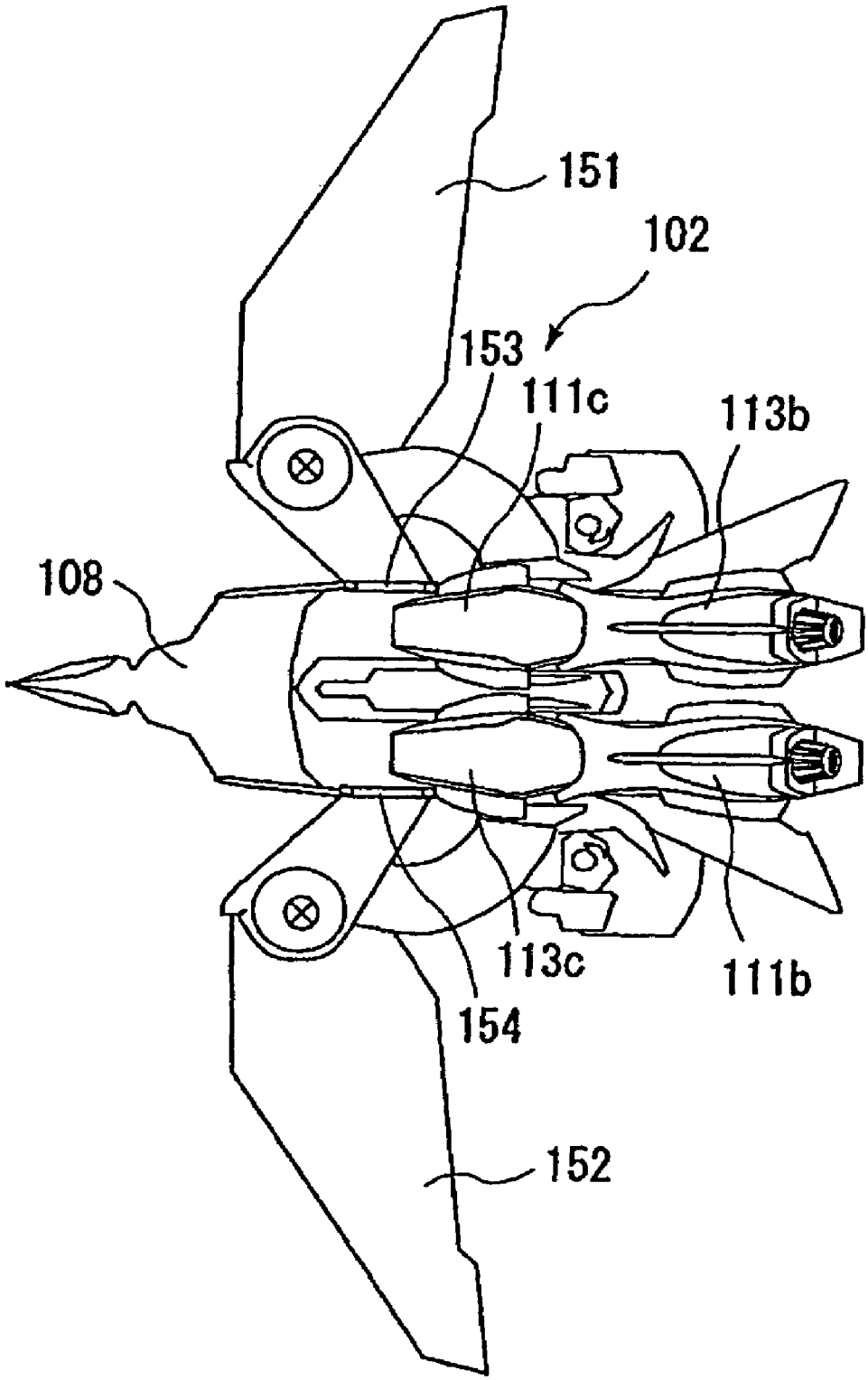
FIG. 17 is a plane view of the transformable toy in a figure of a bird-like robot toy according to the second embodiment of the present invention.
Figure 18:
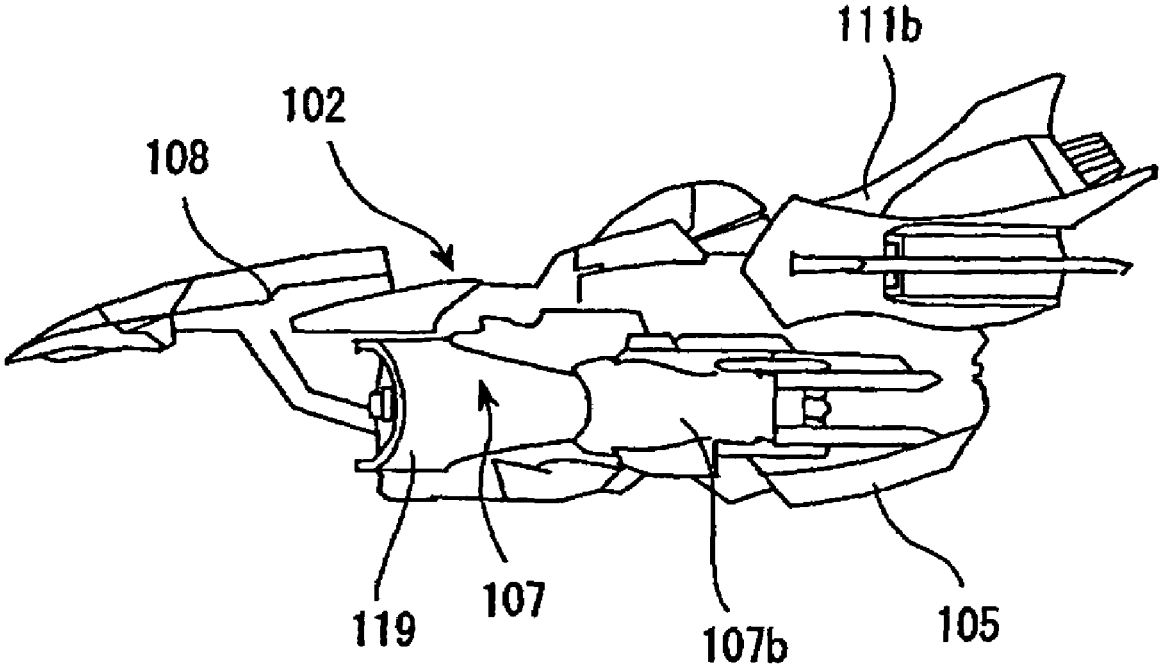
FIG. 18 is a side view of the transformable toy in a figure of a bird-like robot toy according to the second embodiment of the present invention.

FIGS. 15 to 22 are views for illustrating the structure of a transformable toy in accordance with another embodiment of the invention, which is transformed between a doll robot toy and a bird-like robot toy. FIG. 15 and FIG. 16 are a front elevation view and a right side elevation view of a doll robot toy 101; and FIG. 17 and FIG. 18 are a plane view and a side view of a transformed bird-like robot toy 102. In this embodiment, the members identical to those of the embodiment shown in FIGS. 1 to 14 will be given reference numerals which are obtained adding a number of 100 to the reference numerals given in FIGS. 1 to 14; and detailed descriptions thereof will be omitted. This embodiment is largely different from the previous embodiment shown in FIG. 1 to 14 in the following respects: folding wings 151 and 152 are mounted to the back side of the body 105 of the doll robot toy 101 using a pivotally connecting mechanism, i.e., hinges 153 and 154; a head section 103 of the doll robot toy 101 is received within body section 105 of the doll robot toy 101; and an external case, which is dedicatedly used for the bird-like robot toy 102, is not provided.

In the doll robot toy 101 also, each of the leg sections 111 and 113 have a knee-position connecting mechanism 123, which connects thigh section 111*a*, 113*a* and shin section 111*b*, 113*b*, and an ankle-position connecting mechanism (127), which connects the shin section 111*b*, 113*b* and foot section 111*c*, 113*c*. The knee-position connecting mechanism 123 is constructed so as to allow a calf portion of the shin section 111*b*, 113*b* to be placed adjacent to the rear side of the shin section 111*a*, 113*a*. The ankle-position connecting mechanism 127 is constructed so as to allow a sole portion of the foot section 111*c*, 113*c* to be placed adjacent to the back side of the body section 105 of the doll robot toy 101. The pair of leg sections 111 and 113 of the doll robot toy 101 form a tail section of the bird-like robot toy 102 in a state that the calf portion is placed adjacent to the rear side of the thigh sections 111*a* and 113*a*, and the sole portion of the foot sections 111*c* and 113*c* is placed adjacent to the back side of the body section 105 of the doll robot toy 101.

Figure 19:
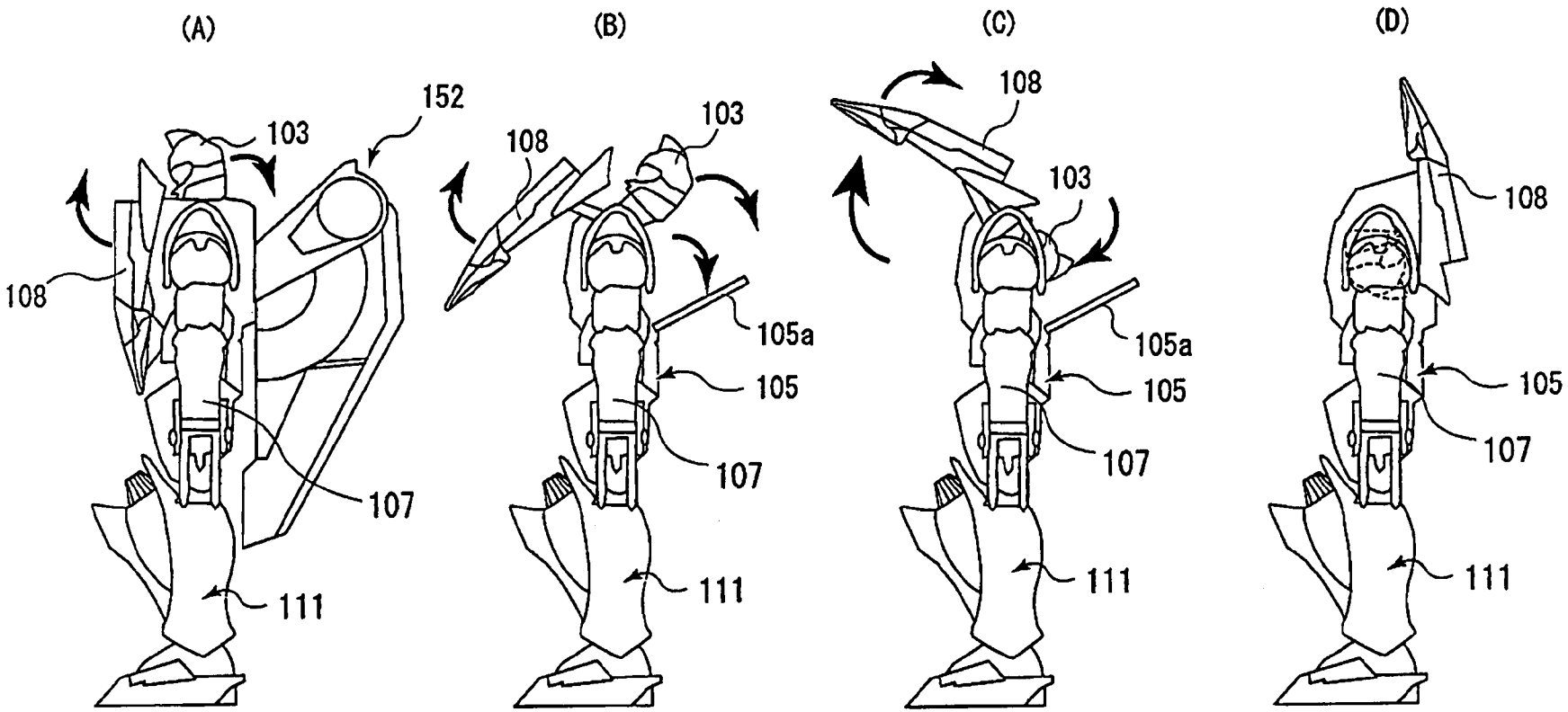
FIGS. 19(A) to (D) are views, each showing a process of transformation of a head section when the doll robot toy is transformed into the bird-like robot toy.
Figure 20:
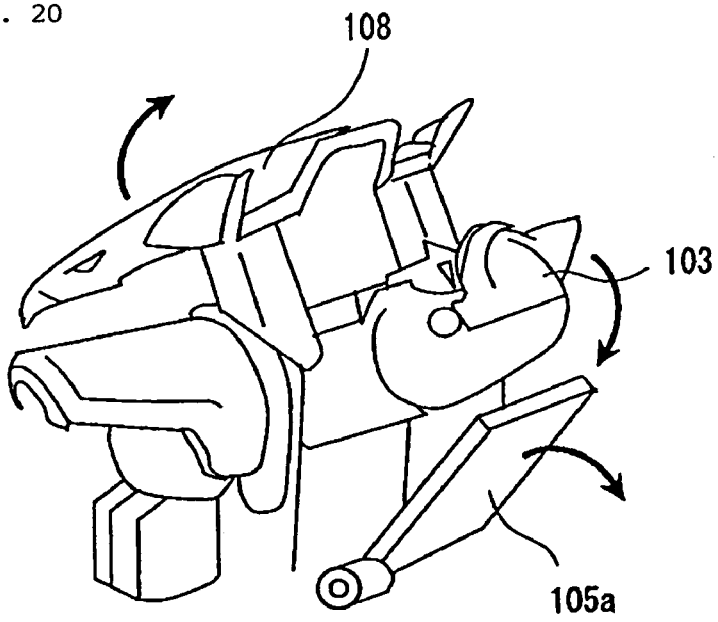
FIG. 20 is a schematic perspective view showing a state when the head section is received in a body section.
Figure 21:
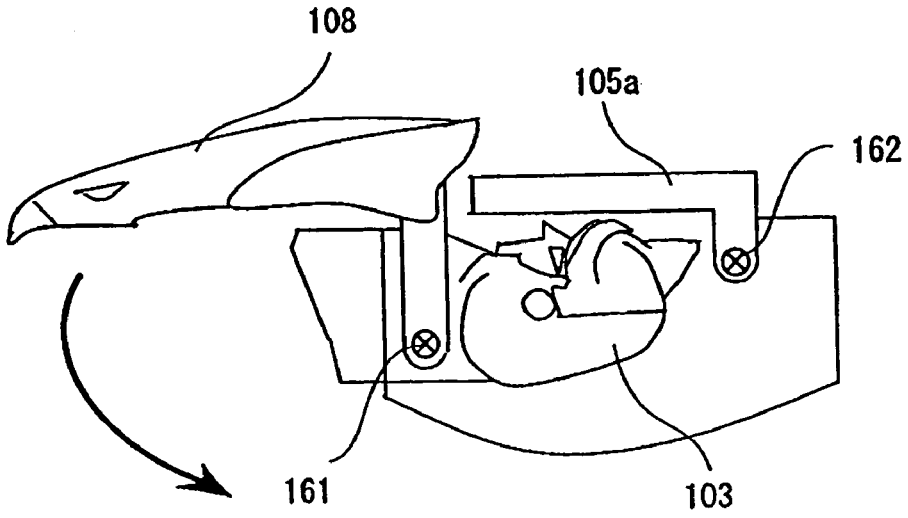
FIG. 21 is a view showing a state of the head section received in the body section.

Referring to FIGS. 19 to 21, the transformation process from the doll robot toy 101 to the bird-like robot toy 102 will be described. From the state shown in FIG. 19(A), the wings 151 and 152 are extended sideward. Hereinafter, the wings will be omitted in the drawing. First, a flap 105*a*, which is provided at the back portion of the body section 105, is opened when receiving the head section 103. Then, the head section 103 is rotated backward, and the head section 103 is received inside the body section 105 through the opening, which is covered by the flap 105*a*. As schematically shown in FIG. 20 and FIG. 21, the head section 103 of the doll robot toy 101 and the head section 108 of the bird-like robot toy 102 rotate together on an axle 161 provided at the body section 105, being combined with each other. The flap 105*a* is rotatably supported to the body section 105 using an axle 162 provided at the body section 105. As shown in FIGS. 19(B) and (C), in a state that the flap 105*a* is opened, after the head section 108 of the bird-like robot toy is rotated and the head section 103 is received inside the body section 105, the flap 105*a* is closed as shown in FIG. 19(D). When the flap 105*a* is closed, the flap 105*a* serves as a stopper to prevent the head section 103 from coming out.

Figure 22:
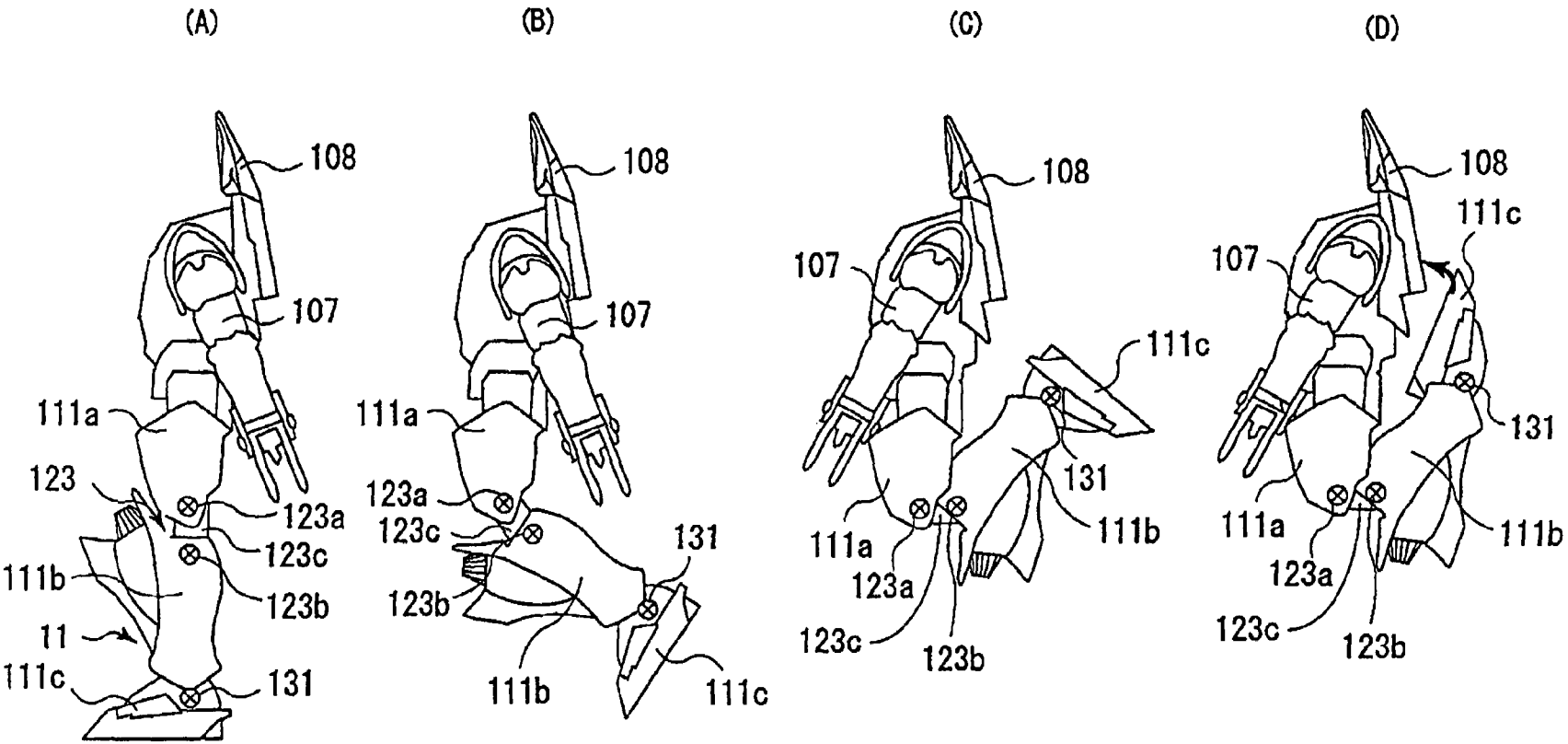
FIGS. 22(A) to (D) are views, each showing a process in which the leg section is transformed.

Then, as shown in FIGS. 22(A) to (D), the leg sections 111 and 113 are folded in the same manner as that in the previous embodiment. In FIG. 22, since the existence of the arm sections is an obstacle to illustrating the structure, the arm section 101 is moved from a predetermined position. In FIG. 22(D), the foot section 111*c* of the leg section 111 is not placed adjacent to the back side of the body section 105 yet. However, in this embodiment, the sole portion of the foot section 111*c* of the leg section 111 finally comes into contact with the back side of the body section 105. As described above, by folding the pair of leg sections 111 and 113, when transformed into the bird-like robot toy 102, the leg sections 111 and 113 of the doll robot toy 101 form the tail section of the bird-like robot toy 102. As a result, the bird-like robot toy 102 can be formed in compact dimensions.

When transforming from the bird-like robot toy 102 into the doll robot toy 101, the above-described steps are carried out in reverse.

INDUSTRIAL APPLICABILITY

According to the present invention, when the doll robot toy is transformed into another robot toy, the long legs of the doll robot toy do not prevent the transformation. Therefore, the figure of the transformed robot toy can be compacted. In particular, according to the present invention, even when the figure of the transformed robot toy includes an exterior and at least a part of the doll robot toy has to be received inside the exterior, the figure of the transformed robot toy can be compacted.

The invention claimed is:

1. A transformable toy of which a figure is transformed between a marine mammal robot toy such as a whale and a doll robot toy, the marine mammal robot toy comprising a head section, a body section and a tail section, the doll robot toy comprising a head section, a body section, a pair of arm sections and a pair of leg sections, wherein each of the leg sections of the doll robot toy includes a thigh section, a shin section, a foot section, a knee-position connecting mechanism for connecting the thigh section and the shin section, and an ankle-position connecting mechanism for connecting the shin section and the foot section;

wherein the knee-position connecting mechanism is constructed so as to allow a calf portion of the shin section to be placed adjacent to a rear side of the thigh section, and the ankle-position connecting mechanism is constructed so as to allow a sole portion of the foot section to be placed adjacent to a back side of the body section of the doll robot toy;

wherein the pair of leg sections of the doll robot toy are received within the head section of the marine mammal robot toy in a state that the calf portion is placed adjacent to the rear side of the thigh section, and that the sole portion of the foot section is placed adjacent to the back side of the body section of the doll robot toy;

wherein the head section of the doll robot toy is received within the body section of the marine mammal robot toy;

wherein at least a part of the head section and the body section of the marine mammal robot toy is dividably constructed so that, when the marine mammal robot toy is transformed into the doll robot toy, the pair of leg sections and the head section of the doll robot toy received therein may be exposed to an outside; and wherein the tail section of the marine mammal robot toy is foldably constructed and mounted onto the back side of the body section of the doll robot toy.

2. The transformable toy according to claim 1, wherein a part of the body section and a part of the arm section of the doll robot toy form a part of the body section of the marine mammal robot toy.

3. The transformable toy according to claim 1, wherein a part of the body section of the marine mammal robot toy is constituted from a pair of body-section forming outer-shell members, and an outer-shell member connecting mechanism for connecting the pair of body section forming outer-shell members to the body section of the doll robot toy in such a manner that the pair of body-section forming outer-shell members are moved left and right respectively, the pair of body-section forming outer-shell members being separated right and left as viewed from the front, and adopted to constitute the part of the body section by moving the body-section forming outer shell members close to each other.

4. The transformable toy according to claim 3, wherein the head section of the marine mammal robot toy is constituted from a pair of head-section forming outer-shell members, and outer-shell member connecting mechanism for connecting the pair of head-section forming outer shell members to the body section of the doll robot toy in such a manner that the pair of head-section forming outer-shell members are moved left and right respectively, the pair of the head-section forming outer-shell members being separated right and left as viewed from the front, and adopted to constitute the part of the head section by moving the head-section forming outer-shell members close to each other.

5. The transformable toy according to claim 4, wherein the pair of head-section forming outer-shell members are shaped so as to form an opening for exposing a part of the pair of leg sections which are completely folded, and the head section of the marine mammal robot toy further includes a cover member for covering the opening; and wherein the cover member is arranged so as to be used as a weapon or shield for the doll robot toy.

6. The transformable toy according to claim 5, wherein the marine mammal robot toy has a pair of detachable flipper sections; and wherein the pair of flipper sections are constructed so as to be used as a weapon for the doll robot toy.

7. A transformable toy of which a figure is transformed between a bird-like robot toy such as a bird and a doll robot toy, the bird-like robot toy comprising a head section, a body section, a tail section and wing sections;

the doll robot toy comprising a head section, a body section, a pair of arm sections and a pair of leg sections, wherein each of the leg sections of the doll robot toy includes a thigh section, a shin section, a foot section, a knee-position connecting mechanism for connecting the thigh section and the shin section, and an ankle-position connecting mechanism for connecting the shin section and the foot section;

wherein the knee-position connecting mechanism is constructed so as to allow a calf portion of the shin section to be placed adjacent to a rear side of the thigh section, and the ankle-position connecting mechanism is constructed so as to allow a sole portion of the foot section to be placed adjacent to a back side of the body section of the doll robot toy;

wherein the pair of leg sections of the doll robot toy form the tail section of the bird-like robot toy in a state that the calf portion is placed adjacent to the rear side of the thigh section, and that the sole portion of the foot section is placed adjacent to the back side of the body section of the doll robot toy;

wherein a mounting structure of the head section of the doll robot toy is constructed so that the head section of the doll robot toy may be received within the body section of the bird-like robot toy; and wherein the wing sections of the bird-like robot toy are foldably constructed and mounted onto the back side of the body section of the doll robot toy.

* * * * *